US005327824A

United States Patent [19]

Wild

[11] Patent Number: 5,327,824

[45] Date of Patent: Jul. 12, 1994

[54] MULTISTORY PRESS HAVING INTEGRAL SUPPORT PLATES AND PRESSURE TRANSMITTING SECTIONS

[75] Inventor: Herbert Wild, Rietberg, Fed. Rep. of Germany

[73] Assignee: WM Wild Maschinen GmbH, Rietberg, Fed. Rep. of Germany

[21] Appl. No.: 977,447

[22] PCT Filed: Jun. 15, 1992

[86] PCT No.: PCT/EP92/01349

§ 371 Date: Apr. 12, 1993

§ 102(e) Date: Apr. 12, 1993

[87] PCT Pub. No.: WO92/22403

PCT Pub. Date: Dec. 23, 1992

[30] Foreign Application Priority Data

Jun. 13, 1991 [DE] Fed. Rep. of Germany ..... 4119528

[51] Int. Cl.[5] ..... B30B 7/02

[52] U.S. Cl. ..... 100/199; 100/208; 425/338

[58] Field of Search ..... 100/193-195, 100/199, 207, 208; 425/338, 339

[56] References Cited

U.S. PATENT DOCUMENTS

| | | | |
|---|---|---|---|
| 2,094,862 | 10/1937 | Welch | 100/199 |
| 2,349,805 | 5/1944 | Tapper | 100/199 X |
| 3,041,666 | 7/1962 | Dorenbos et al. | 100/194 X |
| 3,109,363 | 11/1963 | Collins | 100/195 |
| 3,318,014 | 5/1967 | Whitlow | 34/13.8 |
| 3,638,559 | 2/1972 | Parker | 100/199 X |
| 3,840,314 | 10/1974 | Book | 425/338 |
| 4,222,724 | 9/1980 | van Hüllen | 425/338 X |
| 4,383,814 | 5/1983 | Roccati et al. | 425/338 |
| 4,873,923 | 10/1989 | Manning | 100/258 R |

FOREIGN PATENT DOCUMENTS

| | | | |
|---|---|---|---|
| 0384958 | 9/1990 | European Pat. Off. . | |
| 1153879 | 9/1963 | Fed. Rep. of Germany . | |
| 1182795 | 12/1964 | Fed. Rep. of Germany | 100/199 |
| 1958288 | 1/1967 | Fed. Rep. of Germany . | |
| 1949000 | 9/1970 | Fed. Rep. of Germany . | |
| 1577173 | 9/1972 | Fed. Rep. of Germany . | |
| 2128427 | 12/1972 | Fed. Rep. of Germany . | |
| 1728493 | 7/1973 | Fed. Rep. of Germany . | |
| 3702995 | 8/1988 | Fed. Rep. of Germany . | |
| 9107328 | 8/1991 | Fed. Rep. of Germany . | |
| 306873 | 12/1968 | Sweden | 100/199 |
| 660577 | 11/1951 | United Kingdom . | |

OTHER PUBLICATIONS

Siempelkamp, Pressen fur der Holzindustrie S. 1-7.

*Primary Examiner*—Stephen F. Gerrity
*Attorney, Agent, or Firm*—Pretty, Schroeder, Brueggemann & Clark

[57] ABSTRACT

This invention relates to a multistory press (1) whose press frame ( 2 ) is provided with pairs of supports ( 3, 4 ) and pressure transmitting sections (21) that are each integrally formed so as to simplify the assembly thereof and to reduce the manufacturing costs.

15 Claims, 3 Drawing Sheets

MULTISTORY PRESS HAVING INTEGRAL SUPPORT PLATES AND PRESSURE TRANSMITTING SECTIONS

BACKGROUND OF THE INVENTION

This invention relates to a multistory press for pressing boards of wooden material or veneers or the like and, in particular, to a multistory press having integral support plates and integral pressure transmitting sections.

A multistory press includes a press frame wherein a plurality of press boards, which are, for instance, combined in two units, are movably supported. The press boards are moved with the aid of a pressure means, thereby opening or closing pressure chambers which are formed therein between and in which the material to be processed is pressed. The multistory press of the generic type also includes three tables that are arranged within the press frame. The uppermost table and the lowermost table are here guided in a movable way, with the pressure means moving said tables upwards and downwards. The center table is stationarily arranged within the press frame.

Although the multistory press of the generic type operates in a satisfactory way, in particular at very high pressures, the structure thereof has a relatively heavy weight and is troublesome to mount because of the provision of the three tables.

SUMMARY OF THE INVENTION

It is an object of the present invention to provide a multistory press whose structure is simplified and thus less expensive and which can be mounted in an easy way.

This task is solved by a multistory press for pressing boards having a press frame that includes a plurality of spaced apart pairs of supports. The pairs of supports are arranged such that one support of each pair is opposite the other support of each pair along the two sides of the press frame. A plurality of superimposed press boards are arranged between the supports of each pair of the spaced apart pairs of supports. The plurality of press boards are moveable for forming pressure chambers between adjacent press boards. A pressure cylinder associated with each support includes a cylinder casing fastened to its associated support and a moveable cylinder piston. A pressure transmitting section associated with each pair of the spaced apart pairs of supports includes a first end secured to two moveable cylinder pistons associated with the respective spaced apart pair of supports and a second end operably mounted to the plurality of superimposed press boards for moving the press boards between open and closed positions for forming the pressure chamber. In the preferred embodiment, each pair of the spaced apart pairs of supports are formed by two integral H-shaped support plates that extend from one side to the other side of the press frame and each respective pressure transmitting section is formed by two U-shaped pressure transmitting plates that are spaced apart by spacers and are guided between the two integral H-shaped support plates.

As a result of the provision of integrally formed support pairs and section members, the tables of the generic multistory press can first of all be dispensed with. This helps in an advantageous way to reduce heavy-weight components, which yields a very inexpensive construction of the multistory press of the invention.

Moreover, the multistory press of the invention can be mounted in an easy way. Furthermore, a plurality of press frames can be combined with each other in an advantageous way, so that it is also possible to superimpose a plurality of press story units in response to the respective application.

On the whole, the multistory press of the invention has a structure which can be made easily and is thus inexpensive and which can moreover be used and operated in many ways.

An especially preferred embodiment for the support plates is an H-shaped configuration in which the center beam of the H-shaped support plates forms the part that is formed by the middle stationary table in the multistory press of the generic type.

In an especially preferred embodiment each support consists of two H-shaped support plates which are spaced apart from each other via spacers. The pressure transmitting sections are guided between these spaced-apart support plates.

The spacers of the support plates may be bolt-shaped, so that it is possible to guide these bolt-shaped spacers through an eye of the pressure cylinder Casing, thereby fastening the pressure cylinder between the spaced-apart support plates of the respective support.

An especially preferred embodiment of the section members is a U-shaped configuration, the center beam of the U-shaped section members corresponding, from a functional point of view, to the movable tables of the generic multistory press.

In an especially preferred embodiment each section member consists of two U-shaped section plates that are spaced apart by means of spacers. This makes it possible to hinge the cylinder piston end, which is provided with a fastening eye, to the spacers.

An especially preferred embodiment of the multistory press may have a press board unit arranged above and below a plane. The plane preferably represents, at least approximately, the center plane of the press frame.

With such an arrangement the pressure means is equipped, per support of the press frame, with a pair of pressure cylinders respectively arranged above and below the plane for actuating the respectively assigned press board unit.

With such a configuration the pressure transmitting sections act on the uppermost press board of the upper press board unit and the lowermost press board of the lower press board unit, respectively. When these press boards are moved by the pressure means, a movement of the other press boards is also effected, so that the pressure means can open or close all pressure chambers.

In another embodiment of the inventive multistory press, which is especially preferred, the press boards are interconnected in respective pairs by means of additional pressure cylinders. These additional pressure cylinders are preferably adapted to apply a higher force of pressure than the pressure cylinders of the pressure means. It is thereby possible to selectively open individual or also all pressure chambers against the force applied by the pressure means after said pressure chambers have been closed, so as to be able to remove, for instance, a pressed board from a specific pressure chamber in a selective way while the other pressure chambers are kept closed.

Finally, it is also possible in another preferred embodiment to provide the uppermost press board in each press board unit at its upper side and the lowermost press board at its bottom side with an insulant plate. As a result, it is possible to surround each press board unit by two insulant plates, which preferably improves the efficiency of the heating means of the multistory press of the invention.

Other details, features and advantages of the invention will become apparent from the following description of an embodiment taken in conjunction with the drawing, in which:

BRIEF DESCRIPTION OF THE DRAWINGS

FIG. 4 is a view from the direction of arrows IV—IV in

FIG. 3; and

DESCRIPTION OF THE PREFERRED EMBODIMENT

Figure 1:
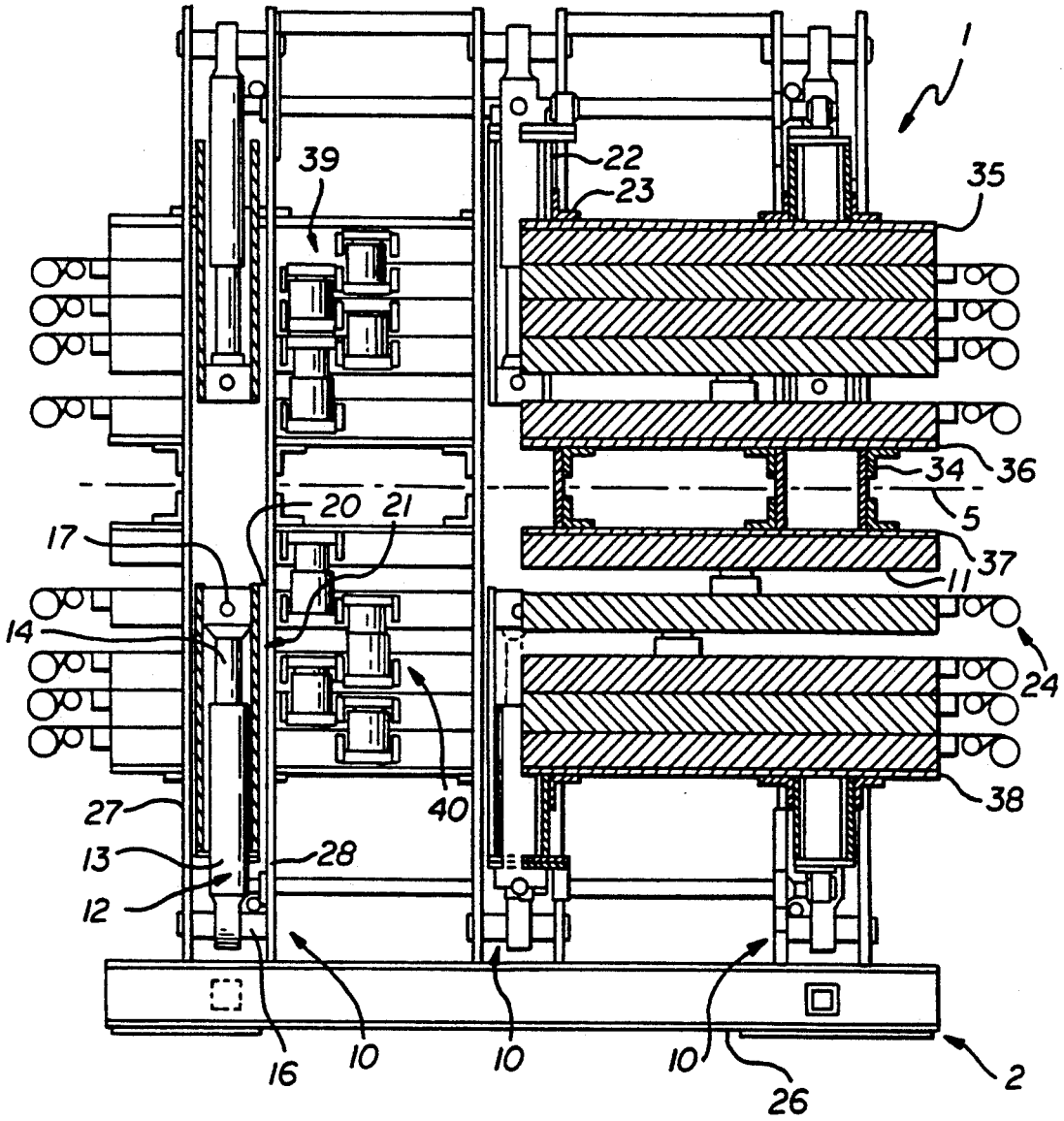
FIG. 1 is a lateral view of an embodiment of the inventive multistory press.
Figure 2:
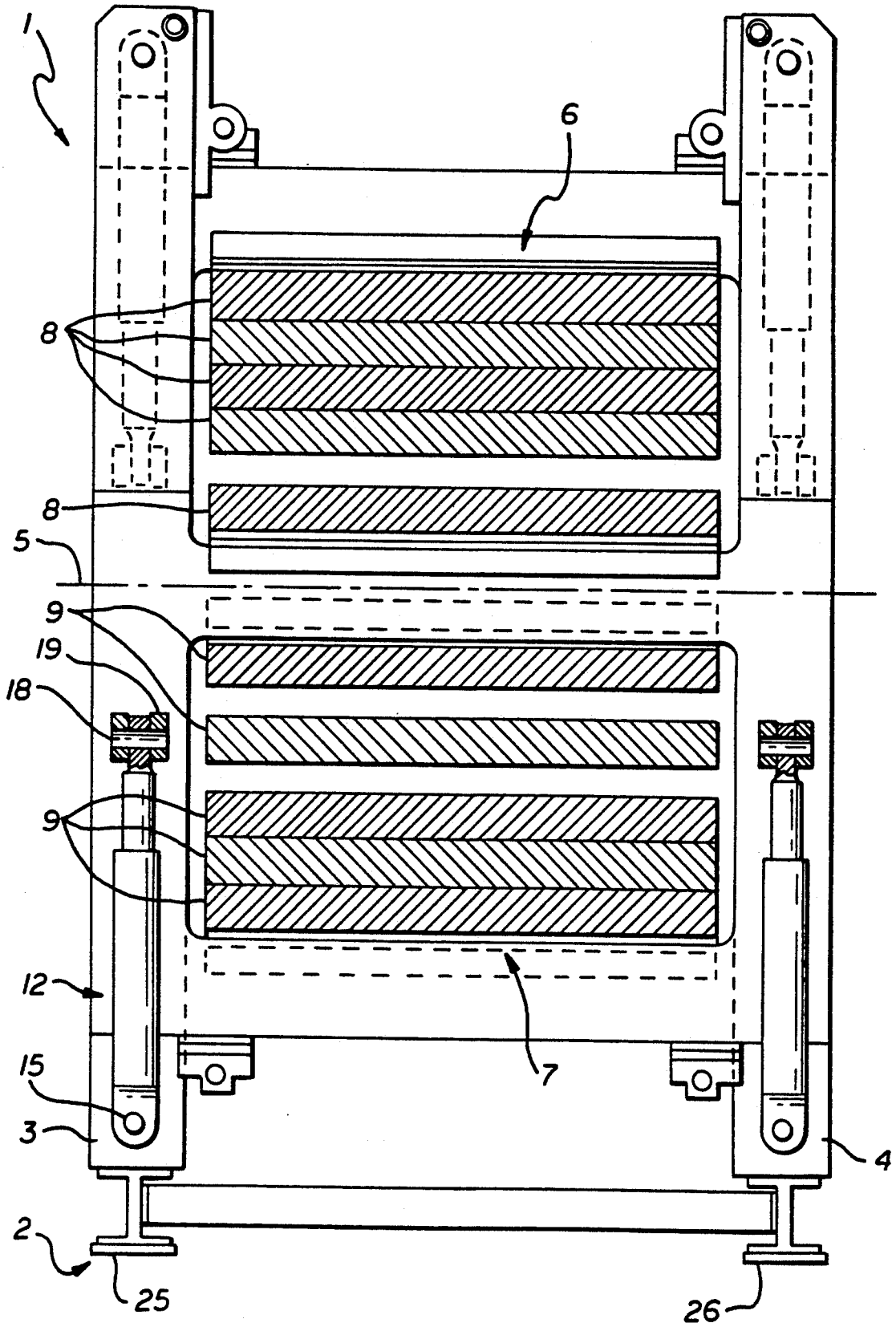
FIG. 2 is a front view of the multistory press of FIG. 1.

FIGS. 1 and 2 illustrate an embodiment of an inventive multistory press 1, which comprises a press frame 2. In the embodiment, press frame 2 comprises three spaced-apart pairs of supports, of which each includes two supports 3 and 4. As becomes apparent from a synopsis of FIGS. 1 and 2, supports 3 and 4 of each pair of supports are arranged opposite each other along the two longitudinal sides (in the embodiment) of press frame 2.

As is especially illustrated in FIG. 2, the multistory press 1 of the invention is equipped, in the embodiment, with two superimposed press board units 6 and 7 that are positioned above and below a center plane 5. In the example each of press board units 6 and 7 has five press boards 8 and 9, respectively. The press boards are movably arranged in press frame 2 and can be moved upwards and downwards with the aid of a pressure fluid means 10. As a result of this movement, pressure chambers can be opened or closed. Out of the respective pressure chambers, FIGS. 1 and 2 illustrate a total of three chambers in the open state, and one of these pressure chambers that is also representative of the other ones is designated by reference numeral 11.

Pressure fluid means 10 comprises a plurality of pressure fluid cylinders, of which six cylinders are visible in FIG. 1 while FIG. 2 illustrates the assignment of two respective cylinder pairs for each support 3 and 4. Since all pressure fluid cylinders have the same structure, reference is only made in the following description to the pressure fluid cylinder which is designated by reference numeral 12.

As becomes apparent from a synopsis of FIGS. 1 and 2, a total of 12 pressure fluid cylinders are provided in the embodiment, with six respective pressure fluid cylinders being assigned in pairs to press board units 6 and 7, respectively, at the two sides of pressure fluid frame 2.

Each of the pressure fluid cylinders 12 has a cylinder casing 13 and a cylinder piston 14. As becomes apparent from FIGS. 1 and 2, cylinder casing 13 is fastened by means of a fastening eye 15 via a bolt-shaped spacer 16 to the respectively associated support. At its eye 17 which is provided at one end, cylinder piston 14 is secured by means of a bolt 18 to a spacer 19 which, in turn, is secured to an end 20 of a pressure transmitting section 21. As becomes especially apparent from the upper half of FIG. 1, the end 22 of section 21 which is opposite to end 20 (all sections of the illustrated embodiment have the same configuration) is secured to one of press boards 8 or in the lower press board unit 7 to one of press boards 9. To this end, an L-shaped fastening member 23 which can be mounted in a suitable way on section 21 or the associated press board 8 and 9, respectively.

As for the general structure of the multistory press 1 as illustrated in FIGS. 1 and 2, it should be noted that a total of four pressure chambers 11 are respectively formed due to the arrangement of five press boards 8 and 9, respectively, per each unit 6 and 7, respectively. As becomes apparent from the illustration of FIG. 1, each pressure chamber has associated therewith a sheet transporting device of identical structure, of which one is designated by reference numeral 24. These sheet transporting devices 24 serve to feed or discharge the material to be pressed in pressure chambers 11.

Furthermore, the press frame comprises two carriers 25 and 26 that extend in longitudinal direction and have arranged thereon the pairs of supports, each consisting of supports 3 and 4 that are disposed at opposite sides of frame 2.

Figure 5:
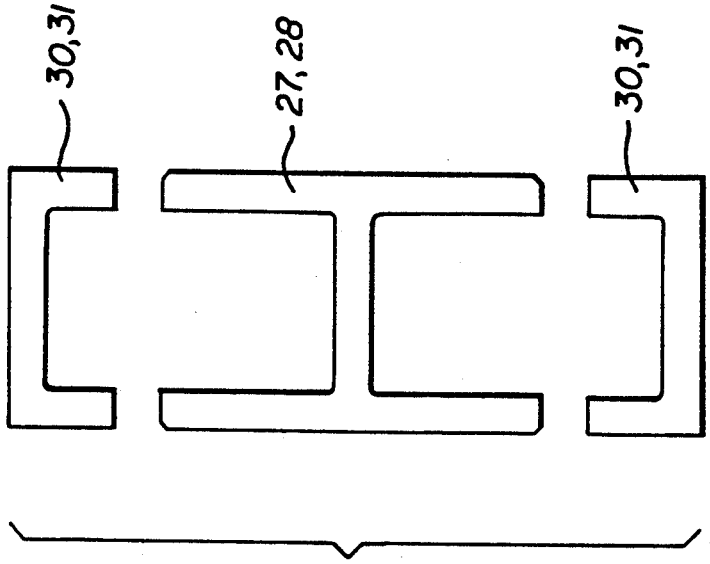
FIG. 5 illustrates the principle regarding the structure and function of the supports and pressure transmitting sections of the multistory press of the invention.
Figure 3:
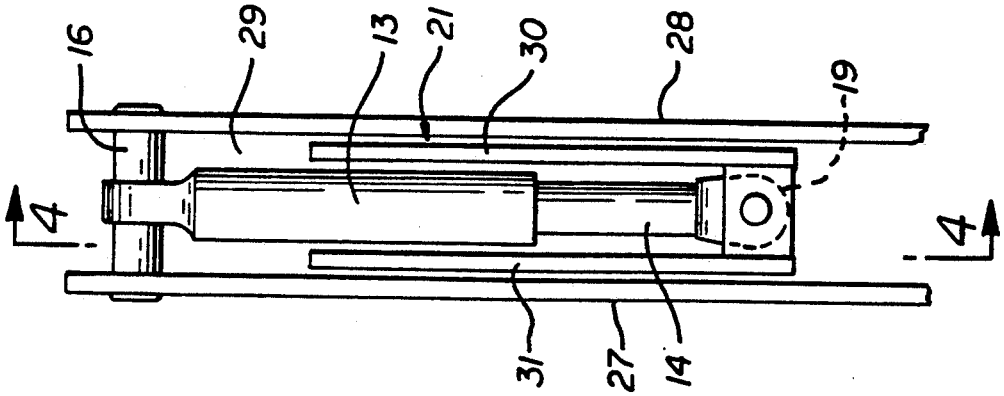
FIG. 3 shows a detail of part of a support of the multistory press of FIGS. 1 and 2.

As follows from the synopsis of FIGS. 1 through 4, the three pairs of supports of the inventive multistory press 1 (in the embodiment) are each formed of two integrally constructed support plates 27 and 28. Each of these support plates 27 and 28 has an H-shaped configuration, which becomes especially apparent from the simplified view of FIG. 5 illustrating the principle thereof. The lateral views of FIGS. 1 and 3 show that the pairs of supports 27 and 28 are each held via the above-mentioned spacers 16 at their predetermined distance from each other. FIGS. 1 and 2 illustrate a total of four spacers 16 which are provided per pair of supports, said spacers 16 respectively connecting said support plates 27 and 28 at their opposite ends, i.e., in the embodiment at the upper end and lower end, respectively. Conventional fastening means, such as screw connections, may be provided for attaching spacers 16.

As a result of the spaced-apart arrangement of support plates 27 and 28, one obtains a space 29 which is positioned between support plates 27 and 28 and has guided therein the pressure transmitting sections 21.

The pressure transmitting sections 21, in turn, are all of the same configuration and formed as an integral section member.

Figure 4:
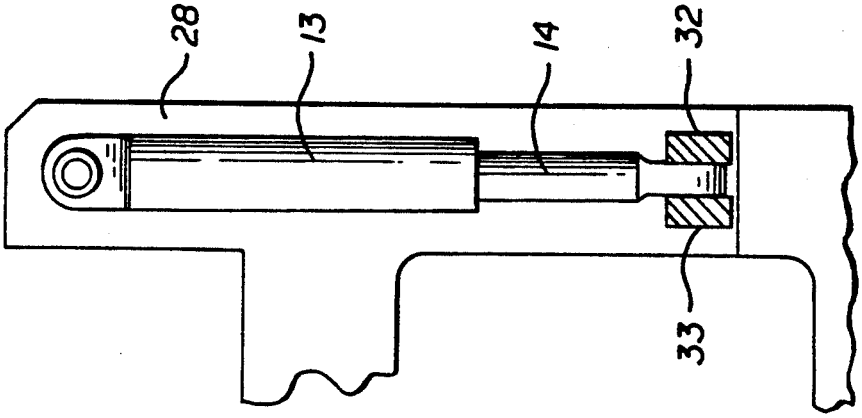

As is especially illustrated in FIGS. 3 to 5, the integral sections or section members 21 are U-shaped when seen in a front view of press frame 2 (according to FIG. 2). Each section member 21 consists of two identically structured U-shaped section plates 30 and 31 that are interconnected through the already mentioned spacer 19, resulting in the spaced-apart arrangement of section plates 30 and 31, as is especially illustrated in FIG. 3. As becomes apparent from FIG. 4, two respective spacer halves 32 and 33 are provided per spacer 19 at the two sides of the piston rod 14 for the articulation of said rod.

It should be noted that the above-described configuration of sections 21 yields two U-shaped configurations, which regard a first U-shaped configuration due to spacers 19 according to a second side view of FIG. 3 and the U-shaped configuration of each section plate 30 and 31, respectively, as follows from the front views of FIG. 2 and FIG. 5, respectively.

As becomes apparent from the synopsis of all figures and, in particular, from the illustration of the principle of+assigning the H-shaped support plates 27, 28 and the U-shaped section plates 30, 31, each pair of supports 3, 4 is formed by the integral support plates 27, 28 which are H-shaped in the embodiment and in which two U-shaped sections 21 consisting of the spaced-apart section plates 30, 31 are respectively guided in a movable way.

As a result of the provision of two press board units 6, 7, the respective pressure transmitting sections 21 of the upper press board unit 6 are fastened to the uppermost press board 8 thereof, while the pressure transmitting sections 21 assigned to the lower press board unit 7 are fastened to the lowermost press board 9 of said unit 7. The lowermost press board of the upper unit 6 and the uppermost press board of the lower unit 7 are each held in a stationary way in the press frame 2 via L-shaped fastening sections, of which one is designated in FIG. 1 by reference numeral 34. Furthermore, it should be noted that the press board units 6 and 7 are each provided on their upper side and lower side, respectively, with two insulant plates 35 and 36 or 37 and 38, respectively.

Finally FIG. 1 shows that each press board unit 6 and 7 is provided with additional pressure cylinders 39 and 40 in the embodiment shown. In the embodiment a total of four additional pressure cylinders 39 and 40 are provided per unit 6 at each of the longitudinal sides of the press frame 2. FIG. 1 illustrates that the pressure cylinders 39 and 40, respectively, interconnect two of the press boards of the associated units 6 and 7. As a result, one obtains a guide for the press boards 8 and 9, respectively. Finally, it is possible to selectively open or close the pressure chambers 11 formed by the associated press boards 8 and 9, respectively.

As a result of the illustrated construction of the multistory press 1 of the invention, a downwardly directed movement of the upper U-shaped pressure transmitting section 21 is achieved during the extension of the piston rod 14 upon actuation of the pressure means 10 according to FIG. 1, whereas an upwardly directed movement of the lower pressure transmitting section 21 is obtained when the piston rod 14 is extended. As a result, pressure chambers 11 are closed for pressing material. When piston 14 is retracted, the corresponding sections 21 of units 6 and 7, respectively, move in the opposite direction.

It should additionally be noted that the multistory press 1 of the invention is of course provided with conventional control means and pressure sources as well as pressure lines to achieve the desired function. These components, however, are not shown in greater detail in the figures and may be constructed in the customary way.

I claim:

1. A multistory press for pressing boards, comprising:

a press frame having two longitudinally extending sides and a plurality of spaced-apart pairs of supports, said plurality of spaced-apart pairs of supports arranged such that one support of each pair is opposite the other support of each pair along the two sides of the press frame;

a plurality of superimposed press boards arranged between the supports of each pair of said spaced-apart pairs of supports, said plurality of press boards being movable for forming at least one pressure chamber between adjacent press boards of said plurality of superimposed press boards;

a pressure cylinder associated with each support of said plurality of spaced-apart pairs of supports, each pressure cylinder having a cylinder casing fastened to its associated support and a movable cylinder piston; and a pressure transmitting section associated with each pair of supports of said plurality of spaced-apart pairs of supports, each pressure transmitting section having a first end secured to the movable cylinder pistons associated with its respective pair of supports and a second end operably mounted to the plurality of superimposed press boards for moving said plurality of press boards between open and closed positions for forming the pressure chamber;

wherein each pair of said spaced apart pairs of supports are formed by two integral, spaced apart H-shaped support plates that extend from one side to the other side of the press frame and wherein each respective pressure transmitting section is guided between the two integral H-shaped support plates.

2. A multistory press according to claim 1, wherein said H-shaped support plates (27,28) are held spaced apart by means of support spacers (16).

3. A multistory press according to claim 2, wherein the support spacers (16) are bolt-shaped, and that said pressure cylinder casing (13) is secured to said support spacers (16).

4. A multistory press according to claim 1, wherein each pressure transmitting section (21) includes two integral pressure transmitting section plates (30, 31) that are spaced apart by means of section spacers (19).

5. A multistory press according to claim 4, wherein said cylinder pistons (14) are hinged to said section spacers (19).

6. A multistory press according to claim 1, wherein said pressure transmitting section (21) is a U-shaped pressure transmitting section plate that extends form one side to the other side of the press frame.

7. A multistory press according to claim 1, wherein each H-shaped support plate includes a center beam and a respective press board unit (6, 7) is arranged above and below a center plane (5) of said press frame (2) defined by the center beams of the H-shaped support plates.

8. A multistory press according to claim 7, wherein each of the pressure transmitting sections (21) includes a first integral pressure transmitting section plate that acts on an uppermost press board (8) of said upper unit (6) and a second integral pressure transmitting section plate that acts on a lowermost press board (9) of said lower unit (7).

9. A multistory press according to claim 7, wherein, in each press board unit (6, 7), an uppermost press board (8 and 9, respectively) is provided at its upper side, and a lowermost press board (8 and 9, respectively) at its lower side, with an insulant plate (35–38).

10. A multistory press according to claim 1, wherein said press boards (8, 9) are connected via additional pressure cylinders (39, 40) between adjacent press boards.

11. A multistory press according to claim 10, wherein said additional pressure cylinders (39, 40) of said press boards (8, 9) are adapted to apply a higher force of pressure than said pressure cylinders (12) associated with each support of said plurality of spaced apart pairs of supports.

12. A multistory press for pressing boards, comprising:

a press frame having two longitudinally extending sides and a plurality of spaced-apart pairs of supports, said plurality of spaced-apart pairs of supports arranged such that one support of each pair is opposite the other support of each pair along the two sides of the press frame;

a plurality of superimposed press boards arranged between the supports of each pair of said spaced-apart pairs of supports, said plurality of press boards being movable for forming at least one pressure chamber between adjacent press boards of said plurality of superimposed press boards;

a pressure cylinder associated with each support of said plurality of spaced-apart pairs of supports, each pressure cylinder having a cylinder casing fastened to its associated support and a movable cylinder piston; and a pressure transmitting section associated with each pair of supports of said plurality of spaced-apart pairs of supports, each pressure transmitting section having a first end secured to the movable cylinder pistons associated with its respective pair of supports and a second end operably mounted to the plurality of superimposed press boards for moving said plurality of press boards between open and closed positions for forming the pressure chamber;

wherein each pair of said spaced apart pairs of supports are formed by two integral, spaced apart support plates that extend from one side to the other side of the press frame and wherein each pressure transmitting section is formed by two integral pressure transmitting section plates that are spaced apart by means of section spacers and are guided between the two integral support plates and said pressure transmitting section plates each extending substantially parallel to each said spaced apart support plate.

13. A multistory press according to claim 12 wherein said pressure transmitting section plates are U-shaped.

14. A multistory press according to claim 13, wherein said support plates (27, 28) are H-shaped.

15. A multistory press according to claim 12 wherein said cylinder pistons (14) are hinged to said section spacers (19). spacers (19).

* * * * *